US006148935A

United States Patent [19]

Wentworth et al.

[11] Patent Number: 6,148,935

[45] Date of Patent: Nov. 21, 2000

[54] JOINT FOR USE IN A DIRECTIONAL BORING APPARATUS

[75] Inventors: Steven W. Wentworth, Brookfield; Robert F. Crane, Oconomowoc, both of Wis.

[73] Assignee: Earth Tool Company, L.L.C., Oconomowoc, Wis.

[21] Appl. No.: 09/212,042

[22] Filed: Dec. 15, 1998

Related U.S. Application Data

[60] Provisional application No. 60/097,694, Aug. 24, 1998.

[51] Int. Cl.[7] ..... E21B 10/00

[52] U.S. Cl. ..... 175/398; 175/19; 166/242.6; 285/330; 403/359.5

[58] Field of Search ..... 166/65.1, 242.6; 175/325.6, 325.7, 325.5, 19, 45, 398; 285/305, 330, 404; 403/359.5, 359.6

[56] References Cited

U.S. PATENT DOCUMENTS

| | | | |
|---|---|---|---|
| Re. 33,793 | 1/1992 | Cherrington et al. . | |
| 4,136,982 | 1/1979 | Sagady | 403/359.5 |
| 4,437,782 | 3/1984 | Geisthoff | 403/359.5 |
| 4,512,596 | 4/1985 | Obrecht | 285/330 |
| 4,945,999 | 8/1990 | Malzahn | 175/19 |
| 4,953,638 | 9/1990 | Dunn | 175/61 |
| 5,070,948 | 12/1991 | Malzahn et al. | 175/19 |
| 5,242,026 | 9/1993 | Deken et al. | 175/62 |
| 5,269,572 | 12/1993 | Mefferd | 285/330 |
| 5,633,589 | 5/1997 | Mercer | 324/326 |
| 5,667,332 | 9/1997 | Lindholm | 403/359.5 |
| 5,778,991 | 7/1998 | Runquist et al. | 175/61 |
| 5,899,283 | 5/1999 | Cox | 175/398 |
| 5,957,226 | 9/1999 | Holte | 285/330 |

FOREIGN PATENT DOCUMENTS

| | | | |
|---|---|---|---|
| 0 857 852 A2 | 5/1998 | European Pat. Off. . | |
| 0 857 853 A2 | 5/1998 | European Pat. Off. | E21B 10/56 |

OTHER PUBLICATIONS

Spirol Coiled Pins brochure, Spirol International Corporation, Feb. 1997, 14 pages.

*Primary Examiner*—William Neuder
*Attorney, Agent, or Firm*—Philip G. Meyers; Gardere Wynne, L.L.P.

[57] ABSTRACT

A joint is provided for coupling a pair of elongated members such as a sonde housing and starter rod end to end. Such a joint includes a projection extending in a lengthwise direction from one end of one of the elongated members and a socket in an end of the other of the elongated members, which socket is sized to slidingly receive the projection. A set of alignable transverse openings are provided in the projection and in a wall defining the socket, which openings are configured to receive a removable retainer for mechanically interlocking the projection in the socket. An interlock mechanism, such as a spline and groove connection, prevents relative rotation between the elongated member (e.g., housing and starter rod) when the projection is fully inserted into the socket. To maximize the strength of the joint, the interlock mechanism is preferably located outside of the projection and socket connection, most preferably as an annular formation of splines and grooves coaxial with the socket and projection and located either on the outside of the projection and the inside of the socket wall, or at a location outside of the socket and groove connection.

31 Claims, 8 Drawing Sheets

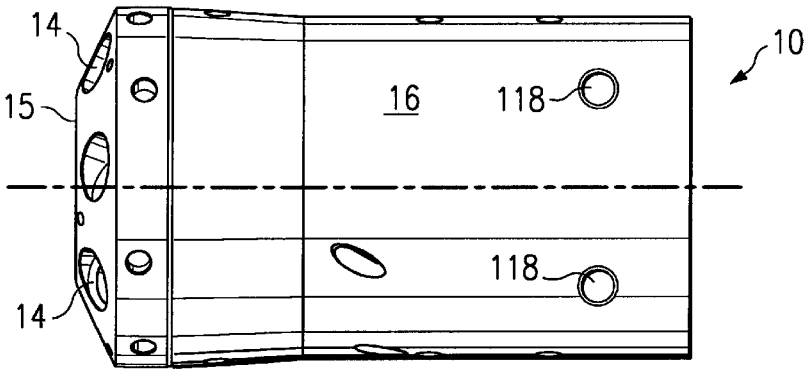
FIG. 4
FIG. 7
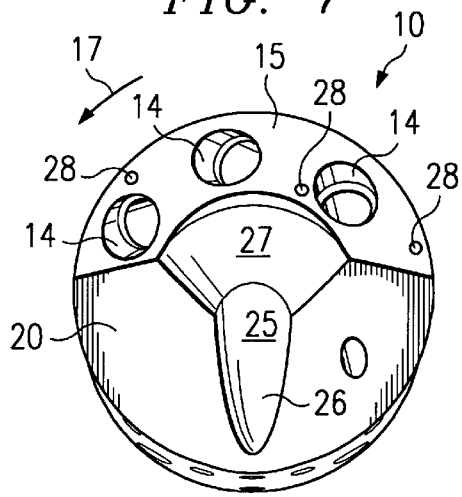
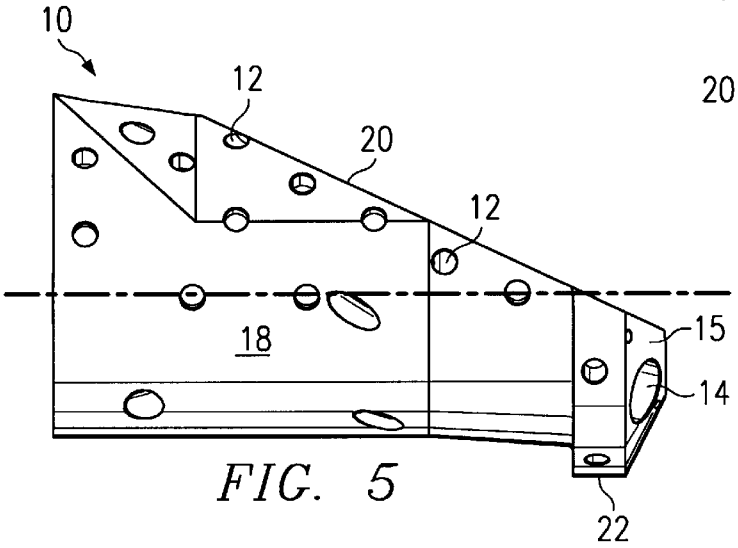
FIG. 5
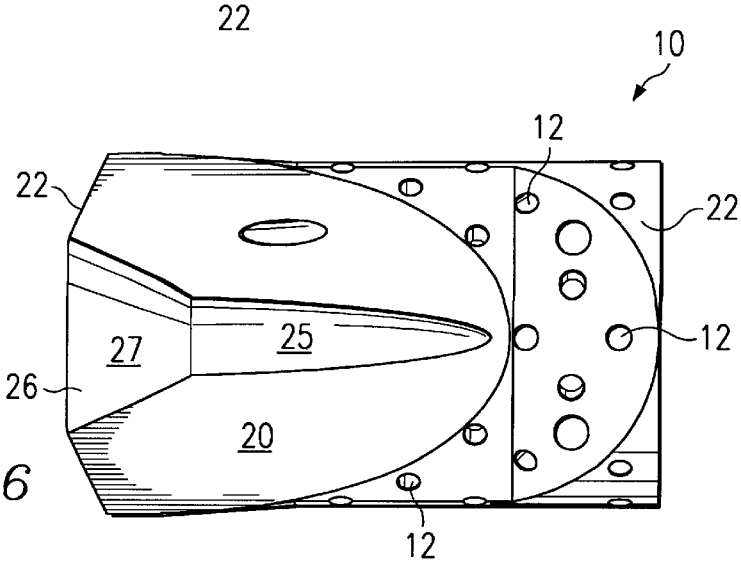
FIG. 6

JOINT FOR USE IN A DIRECTIONAL BORING APPARATUS

CROSS-REFERENCE TO RELATED APPLICATIONS

This application is a conversion from U.S. Provisional Application Ser. No. 60/097,694 filed Aug. 24, 1998, and relied upon for priority.

TECHNICAL FIELD OF THE INVENTION

The invention relates to directional boring, in particular to a directional boring system utilizing an onboard sonde, or locating device, for controlling the direction of the bore wherein a boring head and the sonde are removably mounted to a drill string.

BACKGROUND OF THE INVENTION

Directional boring machines are used to drill holes underneath roads and other obstructions for the installation of gas lines, telephone and electrical cable and other utilities. In the past, installing a gas line or electrical cable across, for example a roadway, required excavation of a trench through the which the utility line was installed. After installation, the trench was backfilled with appropriate material, such as sand, in a series of stages. A layer of fill material was placed in the trench and tamped down, either manually or with a mechanical tamping device. This process was repeated until the trench was filled to a level close to the surface. At this point, the surface of the roadway would be resurfaced with gravel, asphalt, or concrete, depending upon the particular circumstances.

There has been a need for a means of boring under or through obstructions such as roadways, concrete lined waterways and large underground utilities to provide a passageway for utility lines without the need for trenching through or excavating around the particular obstruction. This need has been partially met by the development of a variety of directional boring systems for the installation of underground lines and conduits.

The directional borer generally includes a series of drill rods joined end to end to form a drill string. The drill string is pushed or pulled though the soil by means of a powerful hydraulic device such as a hydraulic cylinder. See Malzahn, U.S. Pat. Nos. 4,945,999 and 5,070,848, and Cherrington, U.S. Pat. No. 4,697,775 (RE 33,793). The drill string may be pushed and rotated and the same time as described in Dunn, U.S. Pat. No. 4,953,633 and Deken, et al., U.S. Pat. No. 5,242,026. A spade, bit or head configured for boring is disposed at the end of the drill string and may include an ejection nozzle for water or mud to assist in boring. More recently, directional boring systems have been devised that can drill through rock. See Runquist et al., U.S. Pat. No. 5,778,991, issued Jul. 14, 1998, and Cox European Patent Publications EP 857,852 and EP 857,853.

Since accurate directional boring necessarily requires information regarding the orientation and depth of a cutting or boring tool, a sensor and transmitting device (a sonde attached to the cutting tool is almost inevitably required to prevent mis-boring and re-boring.) One such device is described in U.S. Pat. No. 5,633,589, the disclosure of which is incorporated herein for all purposes.

Back reamers are commonly used in directional boring to widen the initial bore. According to one known method, a boring head and sonde housing are attached to the front end of a drill string by means of an adapter known as a starter rod, and the machine is then operated to bore through the earth. Additional drill string sections are added as the boring head moves further away from the hydraulic machine that drives it. The head, sonde housing and starter rod eventually emerge at the end of the run at an exit pit or site. The sonde housing is then decoupled from the starter rod, and the sonde housing and boring head are replaced by a back reamer, which is then drawn backwards through the initial bore in order to widen it.

This method has proven effective, but difficulties have arisen when it comes time to decouple the sonde housing from the starter rod. There are two known systems for connecting the front end of starter rod to the rear end of the sonde housing. One is a hex collar connection that is safe but does not provide a reliable connection. According to this approach, a front end of the starter rod is coupled directly to a conical threaded male member at the end of the leading drill rod. The other end has a cylindrical threaded recess that engages a threaded projection at the rear end of the sonde housing. The outer surface of the rear end of the starter rod is hex shaped, as is a shoulder portion of the sonde housing. The starter rod is threaded onto the sonde housing and tightened to the point where the hex surfaces line up, which is just short of full tightness. Then a sleeve for passing torque having a hex shaped opening is slid over both hex surfaces and secured in place using a set screw which is inserted through a hole in the sleeve and engages a threaded hole in the outside of the starter rod.

This coupling suffers from the increased diameter of the sleeve, which becomes the largest diameter part of the head and thus reduces boring effectiveness. It also has poor resistance to side loading, resulting in breakage of the joint during the run, often causing the boring head and sonde to be lost and abandoned in the ground at great cost. The other is a direct threaded connection between the starter rod and sonde housing which is secure but extremely difficult to uncouple after use due to the extremely high torque generated by the directional boring machine. Conventional practice, although contrary to manufacturer recommendations, is to have a workman working on the connection with a pipe wrench at one end of the bore while the machine operator back at the other end of the bore (often 1000 feet away) tries to unscrew the connection by reversing the rotation of the drill string. When the connection gives way, it doe so violently under a huge torque, often causing the wrench to break or fly off at high speed, with the possibility of serious injury to workmen nearby.

A strong, reliable joint that can nonetheless be easily uncoupled without having to use the directional boring machine is sorely needed. The present invention provides a joint which has great strength, yet can be uncoupled with simple hand tools when a bore is completed.

SUMMARY OF THE INVENTION

The present invention provides a joint for coupling a pair of elongated members such as a sonde housing and starter rod end to end. Such a joint includes a projection extending in a lengthwise direction from one end of one of the elongated members and a socket in an end of the other of the elongated members, which socket is sized to slidingly receive the projection. A set of alignable transverse openings are provided in the projection and in a wall defining the socket, which openings are configured to receive a removable retainer for mechanically interlocking the projection in the socket. An interlock mechanism, such as a spline and groove connection, prevents relative rotation between the elongated member (e.g., housing and starter rod) when the projection is fully inserted into the socket.

To maximize the strength of the joint, the interlock mechanism is preferably located outside of the projection and socket connection, most preferably as an annular formation of splines and grooves coaxial with the socket and projection and located either on the outside of the projection and the inside of the socket wall, or at a location outside of the socket and groove connection. The latter is most preferred since the strength of the interlock mechanism is maximized when it is located at the outer periphery of the joint and hence has the largest possible diameter. Similarly, while a partial circle or arcuate formation of splines and grooves could be used, the strength of the connection is maximized by locating the interlock mechanism around the entire outer periphery of the projection and socket connection. However, it is also possible to use a sufficient number of retainers such as roll pins at the joint so that torque may be passed without need for any interlock mechanism, such as the spline and groove arrangement described hereafter. This could be done at either or both of the ends of the sonde housing in the directional boring apparatus described hereafter.

The invention further provides a directional boring apparatus that includes a drill string and a directional boring machine for pushing or pulling as well as rotating the drill string. The head assembly of the boring machine includes a boring bit or head, a housing having an internal chamber for mounting an electronic locating device therein rearwardly of the drilling head for transmitting a signal indicating the orientation or location of the drilling head, and optionally other useful components such as a pressure fluid-powered impact hammer added to assist boring, which components may be connected head to tail in any desired order as long as the boring head or bit is at the front. An adapter or starter rod is mounted at the front end of the drill string. A joint according to the invention is provided at the location at which the starter rod is removably mounted to the head assembly. Normally the joint will be formed by a direct coupling between the front end of the starter rod and the rear end of the housing of the locating device, but other components of the head assembly may intervene.

The joint comprises a projection extending from one of the rear end of the head assembly and the front end of the starter rod, which projection extends in the lengthwise direction of the head assembly and the starter rod and can be inserted in the lengthwise direction of the head assembly and the starter rod to slidingly engage a socket in the other of the head assembly and starter rod. One or more sets of alignable transverse openings are provided in the projection and the wall defining the socket configured to receive a removable retainer for mechanically interlocking the projection in the socket. The retainer has suitable means for resisting disengagement from the transverse openings due to rapid rotation of the joint about an axis which coincides with a lengthwise direction of at least one of the starter rod and the head assembly. An interlock mechanism such as the spline-and-groove arrangement described above prevents relative rotation between the housing and the starter rod when the projection is fully inserted into the socket. A similar joint may be provided at any other joint in the head assembly, such as a joint between the boring head and the sonde housing, or a joint between a mechanically or pressure fluid-powered impact hammer added to assist boring and any adjacent component.

A back reamer may be provided that is configured to fit onto the starter rod when the remainder of the head assembly is removed from the starter rod at the end of the first run. The joint can be resecured using the back reamer instead of the head assembly for the passage back through the borehole. For purposes of the joint, the back reamer effectively is substituted for the head assembly after the head assembly is removed, and for that purpose has a leading end that is configured in the same or substantially the same manner as the rear end of the head assembly so that the back reamer can be coupled with the front of the starter rod to resecure the joint. For this purpose, if it was the head assembly that had the socket therein, then the back reamer will likewise have the socket therein. The configuration of the lead end of the back reamer is substantially the same as the rear end of the head assembly if the back reamer can be coupled with the started rod to re-form the joint; details such as the number of transverse openings and the number of retainers such as roll pins inserted therein can be different as described hereafter. A back reamer according to the invention has a rear conical portion and a front reduced diameter connecting portion that has either the socket or the projection part of the joint formed at its leading end, depending on how the starter rod is configured.

The invention additionally provides a method for attaching and removing a head assembly to the foregoing directional boring apparatus. Initially the starter rod is positioned relative to the head assembly so that the interlock mechanism will become interlocked during insertion of the projection into the socket and the transverse openings provided in the projection and the wall defining the socket come into substantial alignment. The projection is inserted into the socket, thereby causing the interlock mechanism to become interlocked. The retainer is then inserted into the alignable transverse openings provided in the projection and the wall defining the socket to complete the joint. The directional boring machine is operated as needed, such as to bore a hole beneath a roadway. The retainer is then removed from the alignable transverse openings provided in the projection and the wall defining the socket, and the projection is removed from the socket to release head assembly from the drill string. At this point, if desired, the back reamer having a leading end configured in substantially the same manner as the rear end of the head assembly is substituted for the head assembly and mounted on the starter rod, re-forming the joint, and the same steps are substantially repeated, such as in a reverse direction to widen the existing borehole formed on the first pass.

These and other aspects of the invention are described in detail below.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which:

FIG. 4 is a top plan view of a drilling head according to the invention, as shown in FIG. 1, with cutting teeth and carbide buttons removed;

FIG. 5 is a side view of the head shown in FIG. 4;

FIG. 6 is a bottom plan view of the head shown in FIG. 4;

FIG. 7 is a front view of the head shown in FIG. 4;

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention and are not to delimit the scope of the invention.

Figure 1:
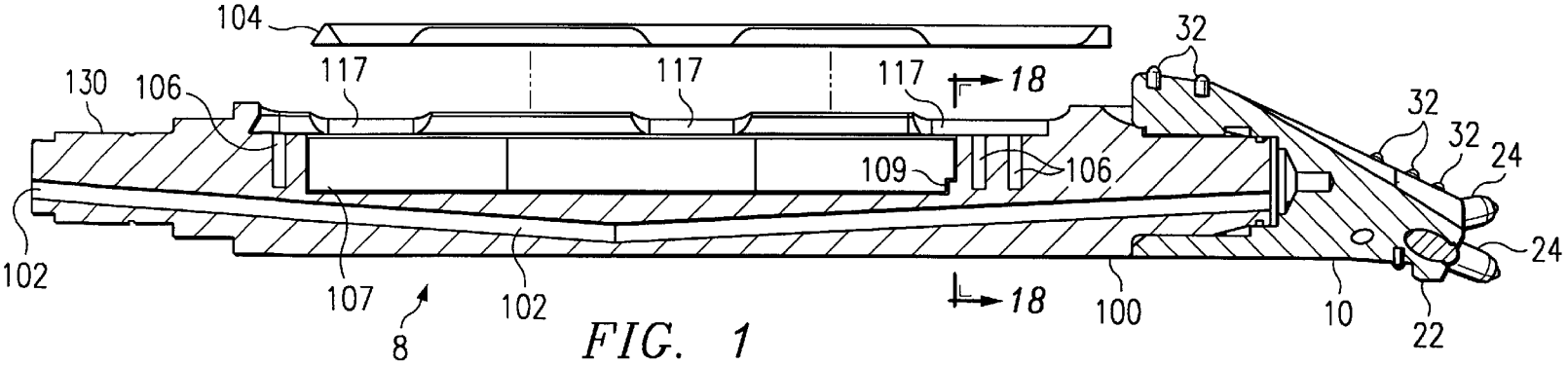
FIG. 1 is a lengthwise view, partly in section of a directional drilling apparatus according to the invention, showing the cover removed and a sonde in place in the housing.
Figure 2:
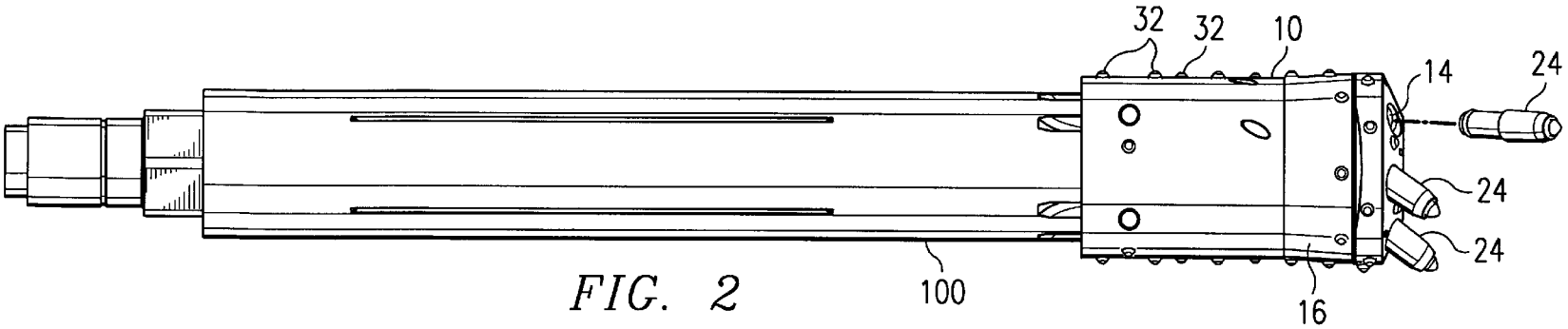
FIG. 2 is a top plan view of the apparatus shown in FIG. 1.
Figure 3B:
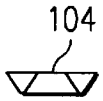
FIG. 3B is a front end view of the cover of FIG. 3B.
Figure 3A:
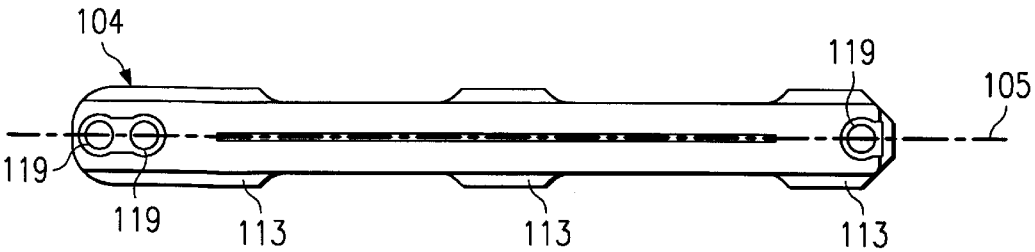
FIG. 3A is a top plan view of the cover for the sonde housing shown in FIG. 1.
Figure 8:
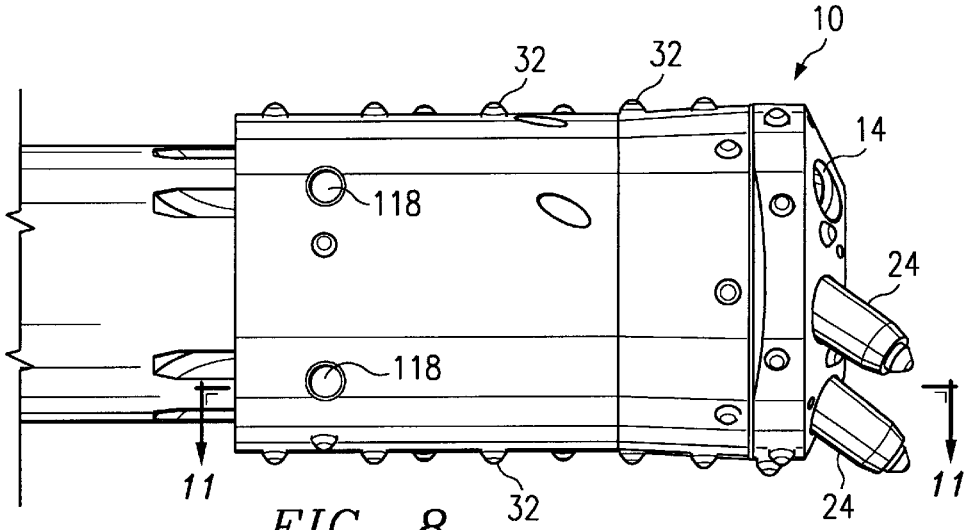
FIG. 8 is a partial, enlarged side view of the head shown in FIG. 4, showing the teeth and carbide buttons.

Referring now to FIG. 1, the horizontal boring/drilling apparatus of the invention is illustrated. The apparatus comprises an elongate body, generally designated as 8. The elongate body includes a cutting or boring head 10, a sonde housing 100, and a sonde cover 104. The cutting head 10 includes a plurality of cutting teeth 24 and a plurality of grinding buttons 32. The drilling or cutting head 10 comprises a generally spade shaped head with a semi-cylindrical top section 16 and a nose section 22.

Sonde housing 100 includes a cavity, generally designated as 108 for receiving a sonde 107. The cavity 108 includes a fitting notch 109 for insuring that the sonde is securely positioned in the cavity 108. A cover 104 is provided to enclose the sonde cavity 108. As illustrated, cover 104 includes three pair of longitudinally extending wings 113 extending laterally from a central axis 105 of the cover. The longitudinally extending wings 113 are matingly adapted to fit into recesses 117 in the top portion of sonde housing 100. Wings 113 are sloped as shown and fit under slanted undercuts 115 to secure the cover 104 in a dove tail fashion that provides additional strength and reduces bending to the housing. This in turn makes it less likely that the door will fail when the sonde housing bends during use.

Threaded apertures 106 extend into the sonde housing 100 correspond to receiving apertures 119 in cover 104 for insertion of set screws or bolts (not shown) to secure cover 104 in position over sonde cavity 108. The sonde housing 100 is equipped to be connected to a drill string 301 at proximate end 130 by means of a conventionally used mechanical coupling such as a threaded connection, wherein the front drill string section comprises a conventional adapter or starter rod. A conventional directional boring machine 300 rotates drill string 301.

The use of a sonde for transmitting orientation (clock position) and depth of the directional boring head is know in the art and this information is important to the operator of the boring device in order to orient the cutting head 10 in the desired direction. In one embodiment of the invention, the sonde 107 transmits electromagnetic waves to convey information regarding the relative position of the drilling head 10.

Thus, for example if the operator wishes to change the direction of the borehole avoid an obstacle it is often necessary to reduce the rate of rotation, or stop rotation of the drill string to orient the cutting tool 10 in the desired direction. Since many conventional horizontal drilling systems use a combination of percussion and rotation for penetration of a substrate, the operator has the option of rotating the spade-shaped cutting tool or head 10 to a desired a desired clock angle and advancing the cutting tool using percussion along the drill string until the cutting tool 10 has achieved the desired orientation. After the desired orientation has been established, normal rotational drilling may be reestablished. Of course, numerous variants upon this technique may be utilized in operation.

Referring now to FIGS. 4–10, the cutting head 10 of the boring system of the invention is illustrated in greater detail. Cutting head 10 includes a pair of retainer receiving apertures 118, which as will be disclosed in greater detail below, comprise part of a unique retaining mechanism for securing the cutting head 10 on the sonde housing 100. The cutting head also includes a plurality of apertures 12 for receiving grinding buttons 32. Preferably the grinding buttons of a conventional tungsten carbide type, well known to those skilled in the art and are typically interference fitted into apertures 12 using known techniques.

Figure 9:
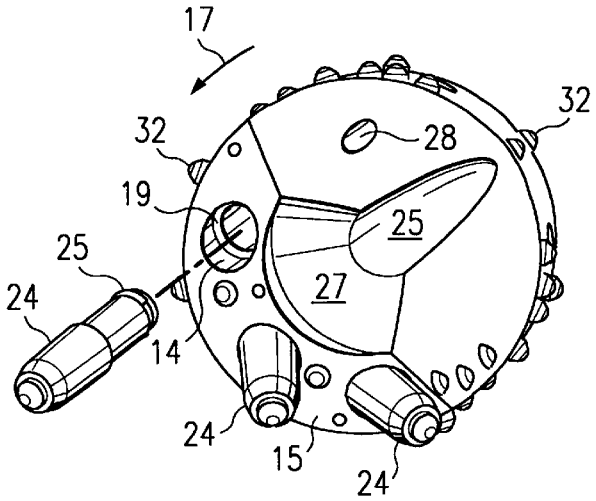
FIG. 9 is a front view of the head shown in FIG. 4, rotated about 120 degrees counterclockwise, showing the teeth and carbide buttons.
Figure 10:
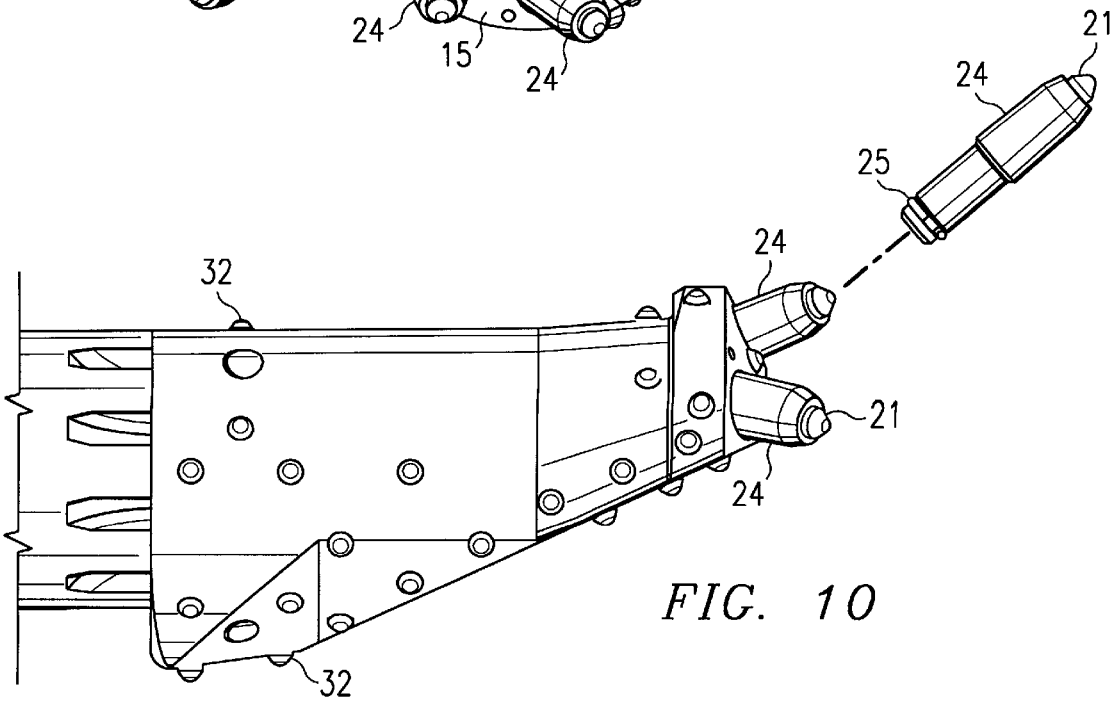
FIG. 10 is a partial side view of the drilling head as shown in FIG. 5, with the tool rotated 180 degrees and showing the teeth and carbide buttons.

Referring specifically now to FIGS. 5, 6 and 7, the top face 22 the cutting head 10 includes a shallow, central rearwardly tapering groove 26. As illustrated, the cutting head 10 of the invention comprises a generally spade-spade shaped body with a semi-cylindrical bottom section 16, an angled top face or section 20 and a nose section 22. The longitudinal groove 26 includes a narrowed first section 25 and a second broader section 27. The longitudinal groove 26 aids in crushing material dislodged during the cutting operation as will be described in further detail below. As shown in FIGS. 5 and 7, nose section 22 includes a plurality of apertures 14 for receiving cutting teeth 24. As best illustrated in FIGS. 7 and 9, apertures 14 are arranged in a generally semi-circular configuration across nose section 22 of cutting head 10. Apertures 14 are canted at an angle of from about 30° to 60° relative to an imaginary line normal to curved front surface 15 of head 10 in the direction of rotation of the cutting head as illustrated by arrow 17. In one embodiment, the cutting teeth 24 are angled in the cutting direction at approximately 30°. The exact angle will depend in part on the slope of the conical end portions 21 of the cutting teeth with a more tapered, sharper point requiring a greater canting degree for the associated tooth 24 in order to provide the desired degree of shearing force to the formation being bored. In this manner, cutting teeth 24 apply a greater shearing force to the rock being bored. A canting angle of less than about 30 degrees, especially 25 degrees or less, provides no significant improvement in cutting.

In contrast, the cutting teeth of at least one prior art cutting head project straight from the cutting head. In this configuration, the straight teeth of the prior art head produce a violent cutting action with the teeth bouncing onto and off of the rock being cut. It has been discovered that the resulting shock and vibration cause a high rate of failure of the sonde and breakage of the drill string of the directional borer. The smoother cutting action of the canted teeth 24 of the cutting head of the present invention greatly reduces these problems.

Cutting teeth 24 include rear annular grooves 25 into which C-spring retaining clips (not shown) are mounted. When the cutting teeth 24 are inserted into apertures 14, the C-spring retaining clips expand into a corresponding groove or enlarged portion 19 of aperture 14 to secure cutting teeth 24 in position. In one embodiment of the invention, the conical tips 21 of the cutting teeth 24 are a tungsten carbide material having a Rockwell hardness on the A scale of 87.

Cutting head 10 also includes one or more fluid ejection ports 28 positioned adjacent to the centrally located longitudinal groove for passage of a fluid. Typically the fluid is a drilling mud, for example, a mixture of water and polymer. The drilling mud serves to lubricate and cool the cutting head 10 and to sweep rock chips and other bored material away from the cutting head during operation.

In one aspect, the joint according to the invention is designed to provide a more secure connection between the cutting head 10 and sonde holder 100. The cutting head 10 is coupled to sonde housing 100 using a splined projection 122 that fits into a corresponding recess 40 in the cutting head. The recess is eccentrically positioned relative to the central axis of the cutting head 10. Eccentric positioning of the coupling between the sonde housing 100 and cutting head 10 provides numerous advantages in directional boring.

Splines 30 are arranged radially in the manner of gear teeth and are elongated in the lengthwise direction of sonde housing 100 the enhance the ability of the drill string to pass torque to the cutting head 10. Splines 30 are received in spline receiving slots 112 in the cutting head 10.

Figure 14:
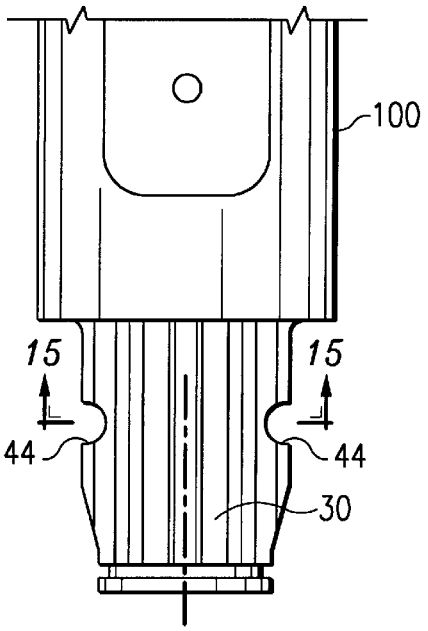
FIG. 14 is a partial top plan view of the splined projection of the sonde housing shown in FIG. 1.
Figure 16:
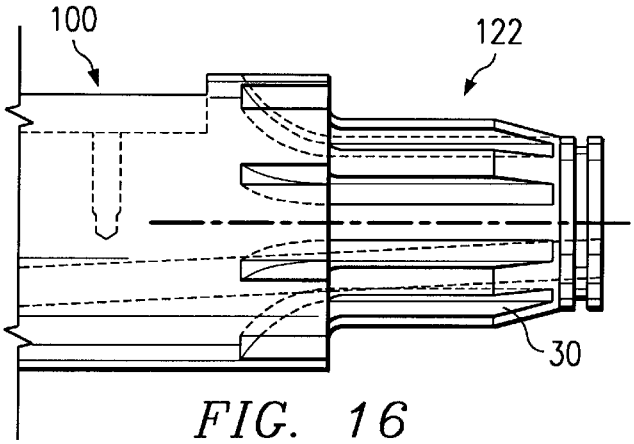
FIG. 16 is a side view, partly in phantom, of the splined projection shown in FIG. 14.
Figure 15:
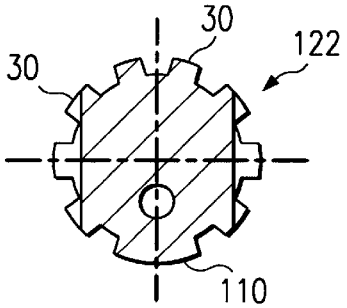
FIG. 15 is a cross-sectional view taken along the line 15—15 in FIG. 14.
Figure 17:
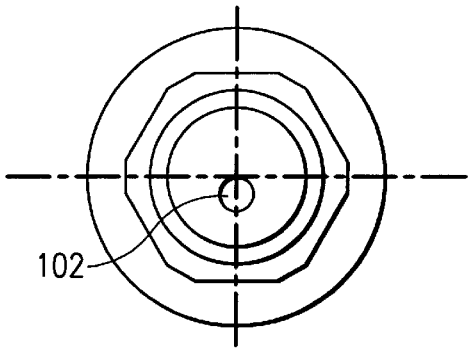
FIG. 17 is a rear end view of the sonde housing shown in FIG. 1.
Figure 18:
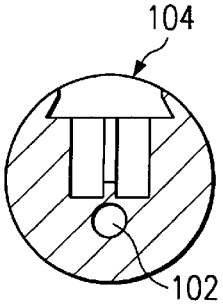
FIG. 18 is a cross-sectional view taken along the line 18—18 in FIG. 1.
Figure 19:
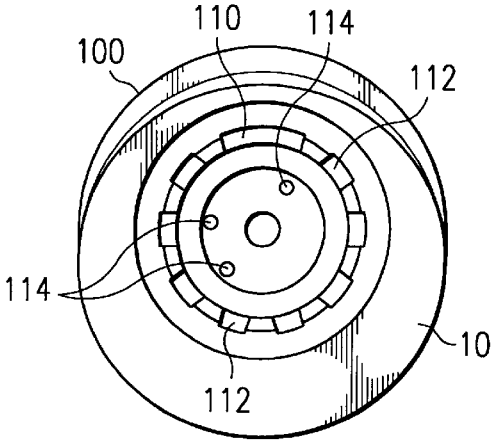
FIG. 19 is a rear view of the drilling head.
Figure 20:
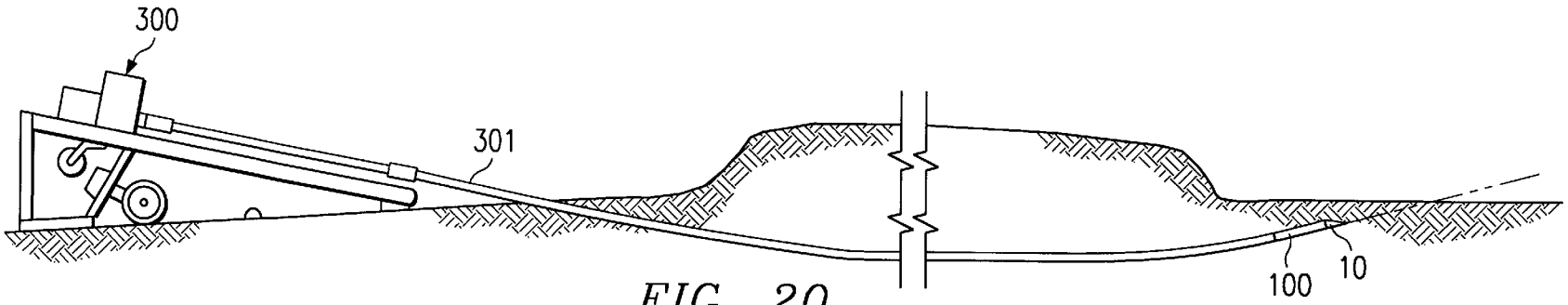
FIG. 20 is a schematic diagram showing the invention in use.
Figure 21:
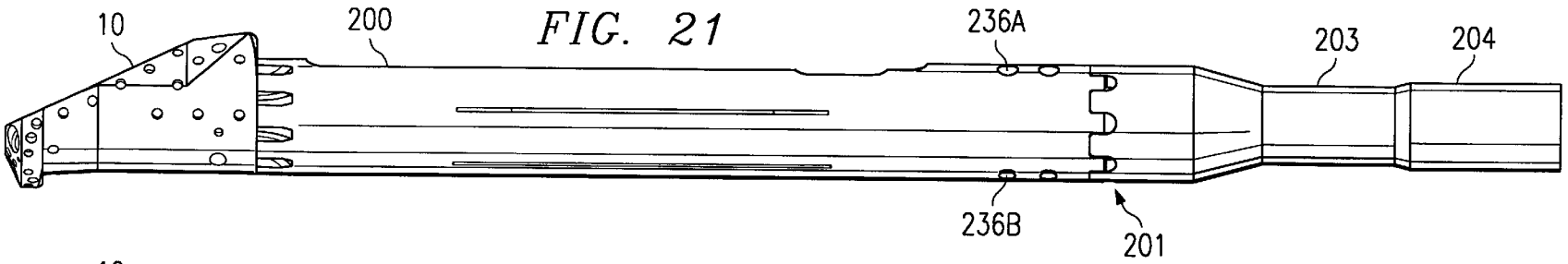
FIG. 21 is a lengthwise side view of an alternative embodiment of a directional drilling head and starter rod according to the invention.
Figure 22:
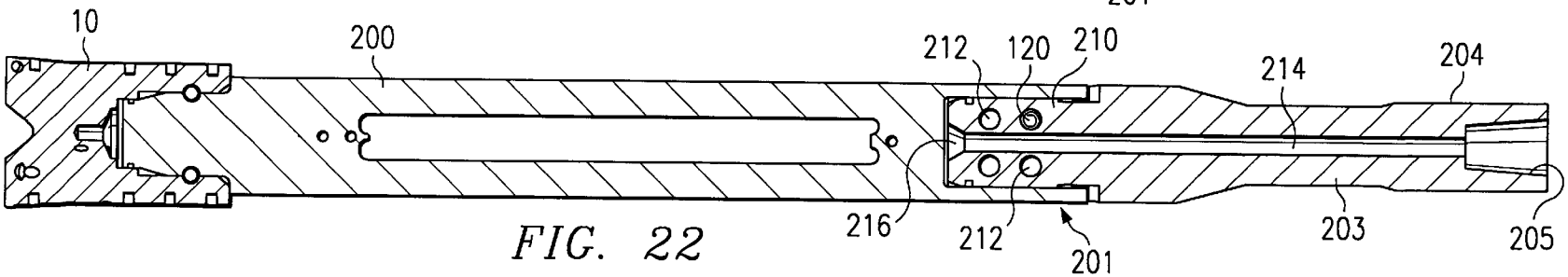
FIG. 22 is a top plan view of the apparatus shown in FIG. 21.
Figure 24:
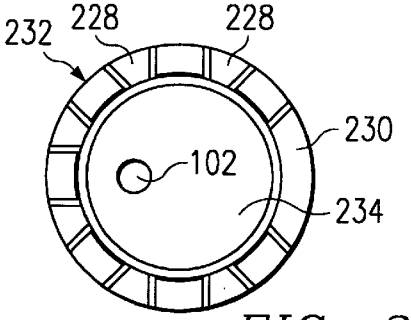
FIG. 24 is a rear end view of the sonde housing of FIG. 23.

As best illustrated in FIGS. 14 and 22, cutting head 10 is aligned with sonde housing 100 by means of a keying arrangement which permits coupling of the cutting head 10 with the sonde housing 100 in only one predetermined configuration. The keying arrangement includes a master spline 110 which is received in a master spline aperture 42. The alignment of master spline 110 with master spline aperture 42 orients the sonde housing cavity 108 in the correct position relative to the upper face or surface 20 of the cutting head 10. The alignment of master spline 110 with master spline aperture 42 also serves to orient fluid passage 102 (FIG. 1) passing through sonde housing 100 with fluid ports 34–38 in the cutting head 10. Although, as illustrated splined projection 122 is cylindrical in shape, it is anticipated that other geometries for splined projection 122 and corresponding recess 40 could be utilized. Likewise, the splined projection 122 could be fabricated as part of cutting head 10 and fit into a corresponding recess in the sonde housing 100.

Figure 13:
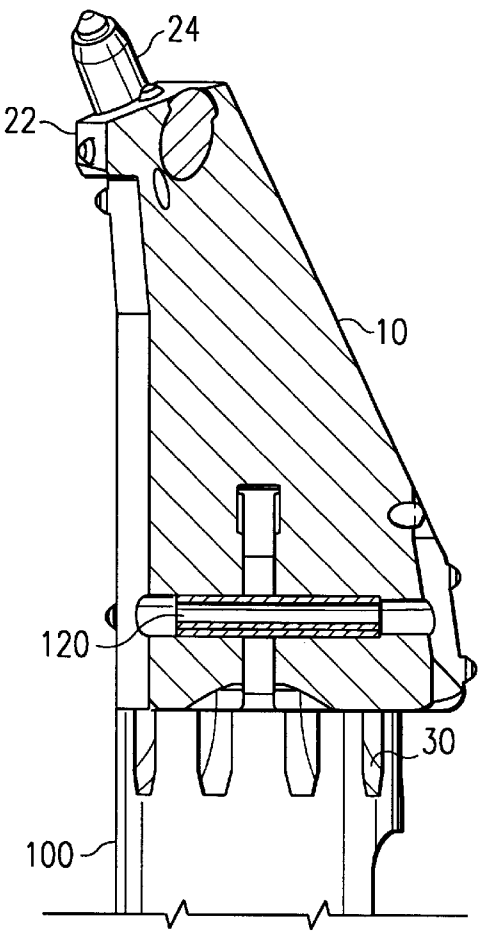
FIG. 13 is the same view as FIG. 12, with a retaining pin shown in lengthwise section inserted into the transverse hole.

In order to secure the splined projection 122 in the receiving aperture 40, a pair of transversely extending retainer apertures 118 are milled through cutting head 10. The retainer apertures 118 intersect corresponding slots 44 milled in the splines 30 at peripheral locations as best shown in FIGS. 13 and 14. In order to provide an adequate interference fit, retainer apertures 118 are milled so that the terminal ends 124 are inclined toward each other. In one embodiment, the retainer apertures are milled at an angle of 1° relative to transverse axis 126. Thus, the terminal ends 124 of the retainer apertures are closer to each other than the proximate ends 123, whereby the alignment of apertures 118 does not match the alignment of slots 44 which are milled in parallel relationship to each other.

The splined projection 122 is secured in the recess 40 with retainers or pins 120. In one embodiment, the retainers are spiral-wound steel plates called roll pins that act in the manner of coil springs when inserted into the apertures 118, resiliently engaging the slots 44 and the walls of the aperture 118, thus, remaining in place despite the violent movements of the cutting head 10 during use. Roll pins are known for use in various mechanical couplings. Pins 120 useful in the present invention have a thickness in the range of about 1/16–1/8", 2–4" length, and a diameter in the range of about 7/16 to 5/8". Pins 120 are generally wound from 1½ to 3 times around. Retainers 120 may also take the form of one or more nested, C-shaped split rings or tubes that engage the walls of the associated holes in the same manner as roll pins.

Since the apertures 118 are canted relative to the corresponding slots 44 in the splined projection 122, the insertion of the roll pins preloads the splines in the driving direction against the corresponding slots. This prevents working of the joint during boring operations that would otherwise shorten the life of the connection and create vibrations that would otherwise shorten the life of the connection and create vibrations that would adversely impact the operation of the sonde.

In order to steer the cutting head 10 in the desired orientation, such as upward, the cutting head is operated to cut in an arc or semicircular profile in the desired direction of travel. After the arc is bored, cutting head 10 is retracted and rotated back a like distance, or the rotation is completed with the head withdrawn so that no cutting occurs. Cutting head 10 is then returned to engagement at the same location and the process is repeated. This process may be accomplished manually or by using an automated system such as described in Runquist et al., U.S. Pat. No. 5,778,991, issued Jul. 14, 1998. Material from the arc-shaped borehole collects in the tapered longitudinal groove 26, effectively forming a ramp upon which cutting head 10 rides. This process gradually results in a change in boring direction, after which the mode of operation is returned to normal to form a circular borehole.

In the above-described process, the apparatus of the invention may be utilized to drill a tunnel or borehole through rock, or rocky substrates, the tunnel being curved or having several angled segments representing initial entry into the ground, horizontal boring under an obstacle such as a roadway, and upward travel towards the surface at the end of the borehole. Cutting head 10 may be readily interchanged with a conventional directional boring head for travel through soft earth, or may be used in the same manner to bore through soft strata, but with reduced efficiency as compared to a boring head designed for normal push-and-turn directional boring through soil.

FIGS. 21–29 illustrate an alternative embodiment of a directional boring head wherein a joint 201 according to the invention is incorporated at both ends of a modified sonde housing 200. Except as described hereafter, the embodiment of FIGS. 21–29 functions in substantially the same manner as that shown in FIGS. 1–20, and as described in co-pending U.S. Provisional patent application Ser. No. 60/097,694 filed Aug. 24, 1998, the contents of which are incorporated by reference herein.

At joint 201, a starter rod 203 has been modified from the conventional design to provide a much more secure connection, but one which can be readily manually removed. A rear end portion 204 of starter rod 203 has a threaded recess 205 for securing rod 203 on the front end of the drill string 301. Given the high stress forces exerted at this juncture on the machine, joint 201 differs from joint 101 described above in a manner that provides greater strength with less elaborate machining of parts. A cylindrical projection 210 coaxial with a lengthwise axis of starter rod 203 extends from a front end of starter rod 203. Projection 210 has four transverse holes 212 extending therethrough at spaced positions, preferably offset from the lengthwise axis of starter rod 203 as shown. An axial mud flow passage 214 extends the length of starter rod 203 for feeding drilling mud to the cutting head 10 through passage 102 in sonde housing 200 (see FIG. 24). A flared end 216 of passage 214 permits communication between passages 214 and 102. A pair of annular grooves 218, 220 are provided on the outer periphery of projection 210 near its front and rear ends. Groove 220 receives an elastomeric O-ring 221 (see FIG. 28) or other suitable seal to prevent leakage from the front end of projection 210. Rear groove 218 is a stress relief undercut.

An interlock mechanism 220 according to this embodiment includes an annular, frontwardly-facing portion 222 of a front end of starter rod 203. Annular portion 222 is located radially outwardly of projection 210 to provide maximum strength to the connection. Portion 222 has a series of arcuate, spaced, frontwardly-extending splines 224 including a master spline 226 having a greater width which performs a keying function in the same manner as master spline 100 as described above.

Figure 23:
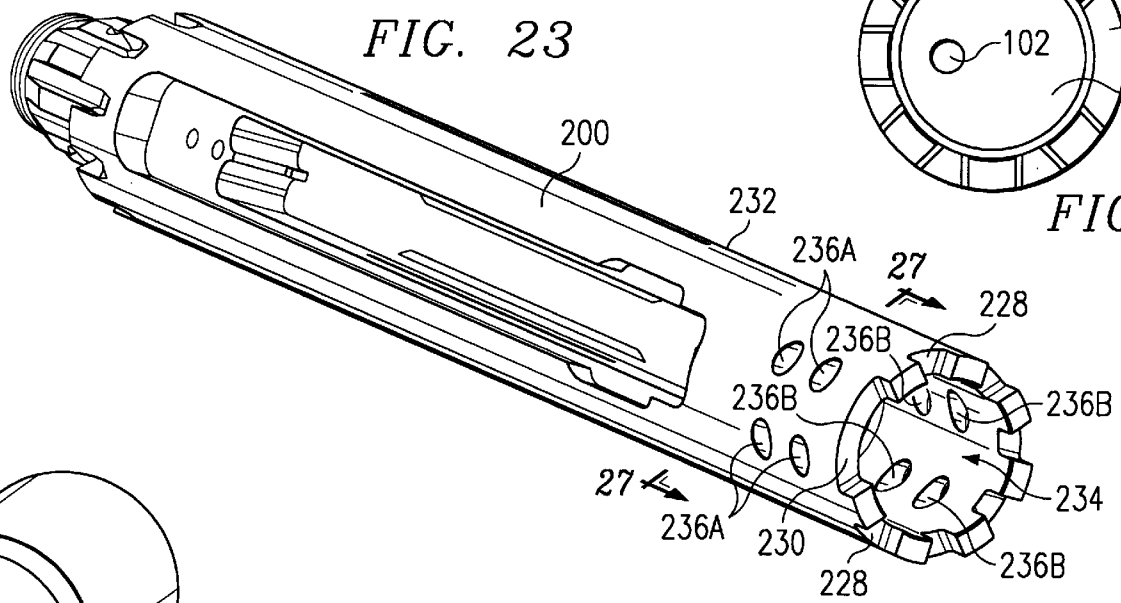
FIG. 23 is a side perspective view of the sonde housing shown in FIG. 21.
Figure 26:
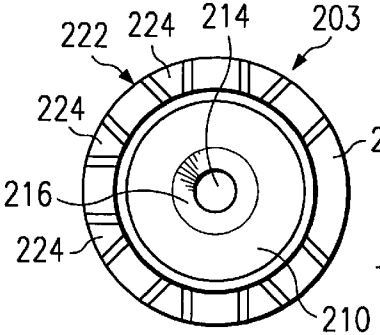
FIG. 26 is a front end view of the starter rod shown in FIG. 25.
Figure 25:
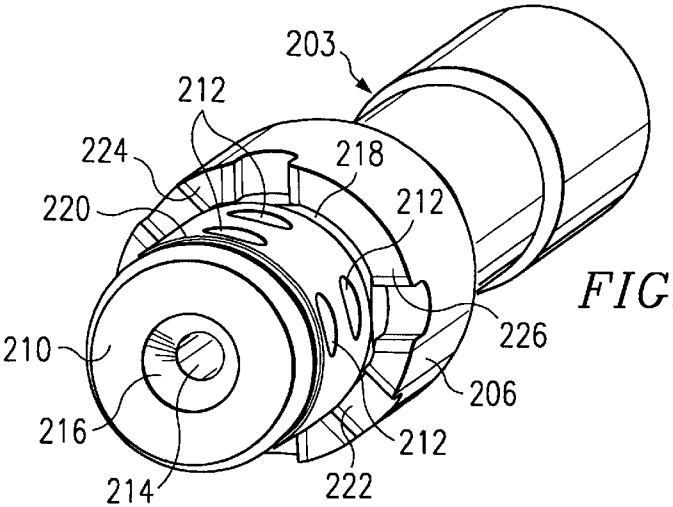
FIG. 25 is a front perspective view of the starter rod shown in FIG. 21.

As shown in FIG. 23, splines 224, 226 are configured to closely engage corresponding grooves 228, 230 in a rearwardly extending annular wall 232 of sonde housing 200, which grooves 228, 230 form the other half of interlock mechanism 220. Splines 224, 226 have radially inwardly tapering sides and curved outer surfaces that coincide with the outer periphery of the front end of starter rod 203. 16. Splines 224, 226 have a length greater than the depth of the associated grooves 228, 230, leaving at least one space between adjacent splines into which a tool for prying apart the elongated members can be inserted.

Projection 210 is slidingly insertable into a rearwardly opening socket 234 in sonde housing 200. Wall 232 has a series of parallel pairs of opposed, elongated, cylindrical through-holes 236A, 236B (four in the embodiment shown, but two or even one may be used) which are brought into near alignment with holes 212 when master spline 226 engages master groove 230. Each pair of holes 236A, 236B has a common lengthwise axis perpendicular to the lengthwise axis of cylindrical projection 210 and socket 234.

Figure 12:
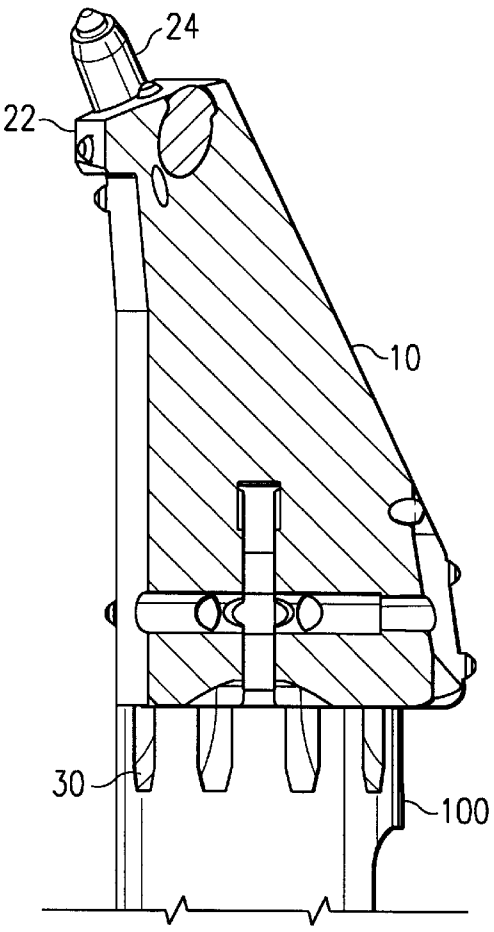
FIG. 12 is the same view as FIG. 11, with the splined projection removed to show the intersection of the transverse holes with a spline receiving groove.
Figure 11:
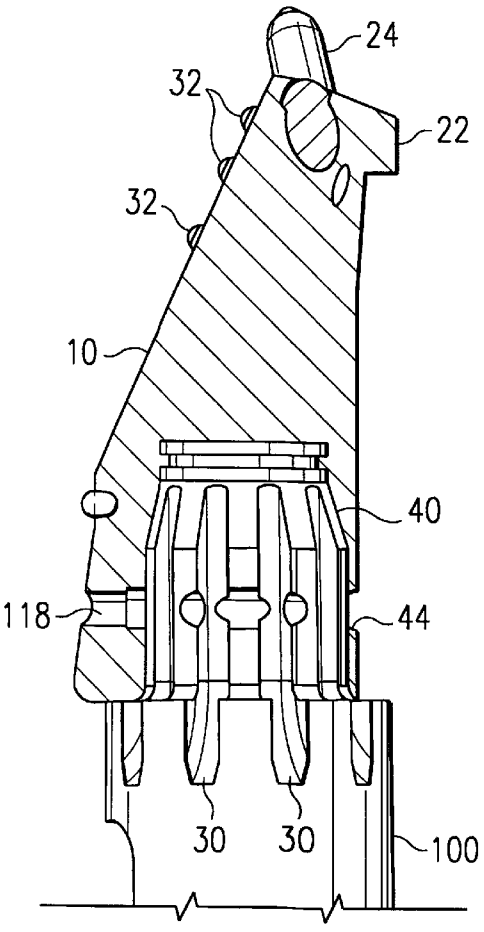
FIG. 11 is a partial side view of the tool of FIG. 1, with the head taken in section along the line 11—11 in FIG. 10.
Figure 27:
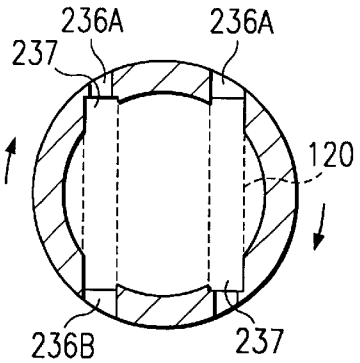
FIG. 27 is a cross-sectional view along the line 27—27 in FIG. 23, with roll pins positions shown in dotted lines.

Alignment of holes 236A, 236B with holes 212 is imperfect because holes 212 are slightly canted in the same manner as described above in connection with apertures 118. When a roll pin 120 is inserted into each set of holes 212, 236A and 236B, splines 224, 226 are preloaded in the driving direction against a side wall of the associated groove 218, 220. If desired, an inwardly-facing step may be provided in holes 236A or 236B to prevent overinsertion of roll pins 120 in the same manner as shown in FIGS. 12 and 13. However, it has been found that at joint 201 the force of rotation is great enough to causes gradual back out of pins 120 unless steps 237 are provided in offset, opposed positions as shown in FIG. 27. Given rotation in the direction of the curved arrow, pins 120 will tend to be thrown against steps 237 in the embodiment shown.

Figure 28:
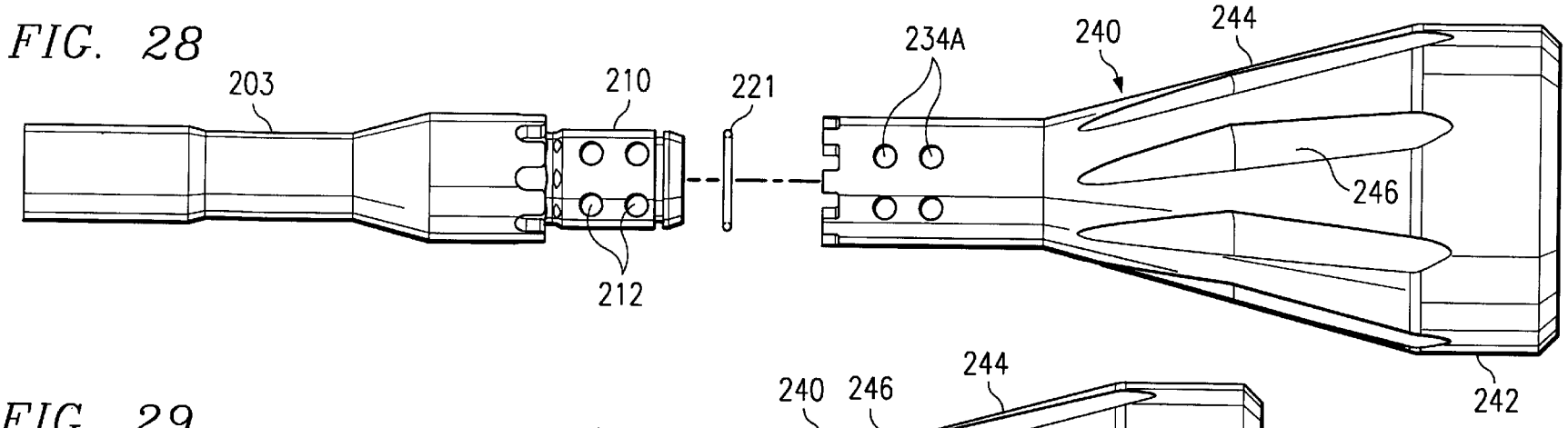
FIG. 28 is an exploded view of a starter rod and back reamer assembly according to the invention.
Figure 29:
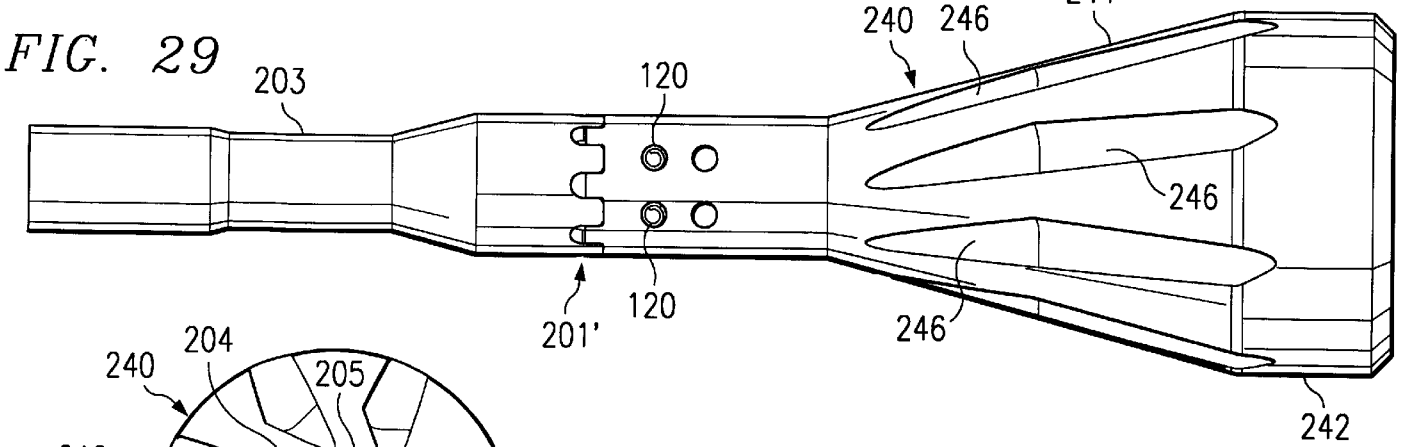
FIG. 29 is an assembled view of the starter rod and back reamer assembly of FIG. 28.
Figure 30:
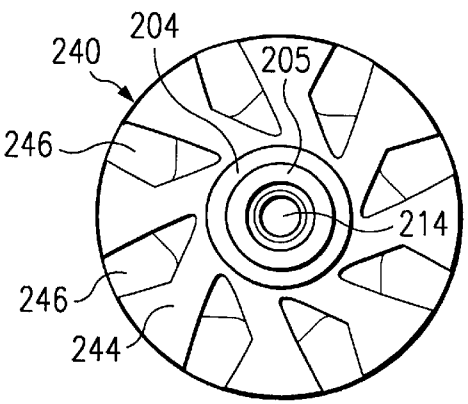
FIG. 30 is a front view of the assembly of FIG. 29.

Referring to FIGS. 28 to 30, as mentioned above, upon completion of a first boring run, the boring head 80 emerges into an exit pit or trench at a location far removed from the directional boring machine 300. At this point a worker may manually remove roll pins 120 with a hammer and chisel, and then remove boring head 80 including housing 200 and head 10 from the unit. A back reamer 240 having a front end configuration substantially matching the rear end of sonde housing 200 may then be mounted on starter rod 203 in place of housing 200, and in this manner the joint 201 according to the invention is re-formed. (The "front" of the device is reversed in this description because the direction of travel is now reversed.) There may be minor differences in the configuration of the front end of reamer 240 in comparison to the rear end of housing 200, for example, fewer holes 234A, 234B may be provided because joint 201' formed with back reamer 240 does not need to be as strong, and the preloading of splines 224, 226 may not be required. If desired, mud or other drilling fluid may flow during back reaming.

Back reamer 240 has an enlarged diameter rear portion 242 which can be pulled or spun and pulled through soft earth to widen the initial borehole during the second run. The forwardly tapering midportion 244 of reamer 240 may have a radially spaced series of longitudinal grooves 246 therein which have edges 248 useful in grinding away rock if the borehole extends through a rock formation. Grooves 246 then conduct material back from the cutting area when reamer 240 functions as a drill bit in this manner. When the back reamer 240 emerges into the original entrance pit, it can be removed from starter rod 203 in the same manner as before, and boring head 80 can be reattached if another borehole needs to be made in a nearby location, such as parallel to the first one.

While certain embodiments of the invention have been illustrated for the purposes of this disclosure, numerous changes in the method and apparatus of the invention presented herein may be made by those skilled in the art, such changes being embodied within the scope and spirit of the present invention as defined in the appended claims. For example, while the invention has been described in one embodiment as particularly suitable for boring through hard, rocky strata, other embodiments of the invention may be advantageously utilized for boring through softer materials.

What is claimed is:

1. A joint for coupling a pair of elongated members end to end, comprising:

a projection extending in a lengthwise direction from one end of one of the elongated members, a socket in an end of the other of the elongated members, which socket is sized to slidingly receive the projection;

a set of alignable transverse openings in the projection and in a wall defining the socket, wherein the transverse opening in the projection comprises an elongated hole having a lengthwise axis transverse to a lengthwise axis of the projection, which openings are configured to receive a removable elongated pin for mechanically interlocking the projection in the socket; and an interlock mechanism for preventing relative rotation between the elongated members when the projection is fully inserted into the socket.

2. The joint of claim 1, wherein the projection is cylindrical and the transverse opening therein comprises an elongated, cylindrical through-hole.

3. The joint of claim 1, wherein the joint has at least two sets of alignable transverse openings in the projection and the wall defining the socket, which sets of openings are at spaced positions on opposite sides of the lengthwise axis of the cylindrical projection.

4. The joint of claim 1, wherein the transverse opening in the wall defining the socket comprises a pair of opposed, coaxial cylindrical through-holes alignable with the transverse opening in the projection.

5. The joint of claim 1, further comprising a removable elongated, substantially straight pin which is insertable into the set of alignable transverse openings in the projection and the wall defining the socket for mechanically interlocking the projection in the socket, which pin has means for resisting disengagement from the transverse openings due to rapid rotation of the joint about an axis which coincides with a lengthwise direction of at least one of the elongated members.

6. The joint of claim 5, wherein the removable pin comprises an elongated roll pin, and the means for resisting disengagement comprises configuring the roll pin to resiliently engage inner surfaces of the alignable transverse openings.

7. The joint of claim 5, wherein the transverse opening in the wall defining the socket has a stop therein which engages one end of the pin when the pin is fully inserted in the aligned transverse openings, which stop is effective for preventing overinsertion of the pin.

8. The joint of claim 7, wherein the stop comprises an annular step formed on an inner surface of the transverse opening in the wall defining the socket.

9. The joint of claim 5, wherein the roll pin comprises a steel sheet having a thickness in the range of about 1/16–1/8", a length of 2–4", and a diameter in the range of about 7/16 to 5/8", and which has been spiral wound at least about one and one-half times.

10. The joint of claim 1, wherein the projection has a lengthwise fluid passage extending therethrough, which passage opens on a front end face of the projection, and has an annular gasket which engages the wall defining the socket and is effective for preventing fluid leakage from the joint.

11. The joint of claim 1, wherein the interlock mechanism comprises a series of spaced splines which extend in a lengthwise direction of the elongated members and engage a series of grooves in the other of the elongated members in a manner effective to prevent relative rotation between the elongated members when the projection is fully inserted into the socket.

12. The joint of claim 11, wherein the splines and grooves are disposed in an annular formation on the outer periphery of the projection and on the wall defining the socket.

13. The joint of claim 11, wherein the splines and grooves are disposed in an annular formation at positions radially outwardly from the socket and projection relative to the lengthwise axis of the projection.

14. The joint of claim 13, wherein the splines taper radially inwardly and a radially outermost curved surface of each spline is disposed on an outer periphery of the associated elongated member.

15. The joint of claim 13, wherein the splines have a length greater than the depth of the associated grooves, leaving at least one space between adjacent splines into which a tool for prying apart the elongated members can be inserted.

16. The joint of claim 11, wherein one of the splines comprises a master spline having a size different from that of another spline, and one of the grooves comprises a master groove having a size different from that of another groove, which master spline fits the master groove to permit coupling of the elongated members in only one predetermined configuration.

17. In a directional boring apparatus including a drill string, a directional boring machine for pushing as well as rotating the drill string, a head assembly including a boring head and a housing having an internal chamber for mounting an electronic locating device therein rearwardly of the drilling head for transmitting a signal indicating the orientation or location of the drilling head, a starter rod mounted at the front end of the drill string, and a joint at which the starter rod is removably mounted to a rear end of the head assembly, the improvement wherein the joint comprises:

a projection extending from one of the head assembly and the starter rod, which projection extends in the lengthwise direction of the head assembly and the starter rod, and can be inserted in the lengthwise direction of the head assembly and the starter rod to slidingly engage a socket in the other of the head assembly and starter rod, wherein one or more sets of alignable transverse openings are provided in the projection and a wall defining the socket configured to receive a removable elongated pin for mechanically interlocking the projection in the socket, wherein the transverse opening in the projection comprises an elongated hole having a lengthwise axis transverse to a lengthwise axis of the projection; and an interlock mechanism for preventing relative rotation between the housing and the starter rod when the projection is fully inserted into the socket.

18. The apparatus of claim 17, wherein the interlock mechanism comprises a series of spaced splines arranged in an arcuate formation on one of the head assembly and the starter rod, which splines extend in a lengthwise direction of the head assembly and the starter rod and engage a series of grooves in the other of the head assembly and starter rod in a manner effective to prevent relative rotation between the housing and the starter rod.

19. The apparatus of claim 18, wherein the splines and grooves are disposed in an annular formation at positions radially outwardly from the socket and projection relative to the lengthwise axis of the projection.

20. The apparatus of claim 19, wherein the splines have radial side walls such that the splines taper radially inwardly, and a radially outermost curved surface of each spline is disposed on an outer periphery of the associated starter rod or head assembly.

21. The apparatus of claim 19, wherein the starter rod has a front cylindrical portion and a rear cylindrical portion, the radially outermost curved surface of each spline adjoins a cylindrical outer periphery of the front end portion of the starter rod, and the rear cylindrical portion of the starter rod has a threaded opening therein configured for connection to the drill string.

22. The apparatus of claim 18, wherein the splines have a length greater than the depth of the associated grooves, leaving at least one space between adjacent splines into which a tool for prying apart the starter rod and the head assembly can be inserted.

23. The apparatus of claim 17, wherein the projection is cylindrical and the joint has at least two sets of alignable transverse openings in the projection and the wall defining the socket, which sets of openings are at spaced positions on opposite sides of the lengthwise axis of the cylindrical projection, and the transverse openings in the cylindrical projection comprise a pair of elongated, parallel, cylindrical through-holes having a lengthwise axis perpendicular to a lengthwise axis of the cylindrical projection, and each transverse opening in the wall defining the socket comprises a pair of opposed, coaxial cylindrical through-holes alignable with the associated transverse opening in the projection.

24. The apparatus of claim 17, further comprising a removable elongated pin which is insertable into the set of alignable transverse openings in the projection and the wall defining the socket for mechanically interlocking the projection in the socket, which pin has means for resisting disengagement from the transverse openings due to rapid rotation of the joint about an axis which coincides with a lengthwise direction of at least one of the starter rod and the head assembly.

25. The apparatus of claim 24, wherein the removable pin comprises an elongated roll pin, and the means for resisting disengagement comprises configuring the roll pin to resiliently engage inner surfaces of the alignable transverse openings.

26. The apparatus of claim 24, wherein the transverse opening in the wall defining the socket has a stop therein which engages one end of the pin when the pin is fully inserted in the aligned transverse openings, which stop is effective for preventing overinsertion of the pin.

27. The apparatus of claim 17, wherein the projection has a lengthwise fluid passage extending therethrough, which passage opens on a front end face of the projection, and has an annular gasket which engages the wall defining the socket and is effective for preventing fluid leakage from the joint.

28. The apparatus of claim 17, wherein the outer surface of the projection is configured for direct linear insertion into the socket without rotating the projection relative to the socket.

29. A method for attaching and removing a head assembly to a directional boring apparatus including a drill string and a directional boring machine for pushing or pulling as well as rotating the drill string, wherein the head assembly includes a boring head, a housing having an internal chamber for mounting an electronic locating device therein rearwardly of the drilling head for transmitting a signal indicating the orientation or location of the drilling head, a starter rod mountable at the front end of the drill string, and a joint at which a front end of the starter rod is removably mounted to a rear end of the head assembly, wherein the joint comprises a projection extending from one of the rear end of the head assembly and the front end of the starter rod, which projection extends in the lengthwise direction of the head assembly and the starter rod and can be inserted in the lengthwise direction of the head assembly and the starter rod to slidingly engage a socket in the other of the head assembly and starter rod, wherein one or more sets of alignable transverse openings are provided in the projection and a wall defining the socket configured to receive a removable elongated pin for mechanically interlocking the projection in the socket, the pin having means for resisting disengagement from the transverse openings due to rapid rotation of the joint about an axis which coincides with a lengthwise direction of at least one of the starter rod and the head assembly, and an interlock mechanism for preventing relative rotation between the head assembly and the starter rod when the projection is fully inserted into the socket, the method comprising the steps of:

positioning the starter rod relative to the head assembly so that the interlock mechanism will become interlocked during insertion of the projection into the socket and the transverse openings provided in the projection and the wall defining the socket come into substantial alignment;

inserting the projection into the socket, thereby causing the interlock mechanism to become interlocked;

inserting the pin into the alignable transverse openings provided in the projection and the wall define the socket;

operating the directional boring machine;

removing the pin from the alignable transverse openings provided in the projection and the wall defining the socket; and removing the projection from the socket so that the head assembly is removed from the starter rod.

30. The method of claim 29, further comprising the steps of:

substituting for the head assembly a back reamer having a leading end configured in substantially the same manner as the rear end of the head assembly;

positioning the starter rod relative to the back reamer so that the interlock mechanism will become interlocked during insertion of the projection into the socket and the transverse openings provided in the projection and the wall defining the socket come into substantial alignment;

inserting the projection into the socket, thereby causing the interlock mechanism to become interlocked;

inserting the pin into the alignable transverse openings provided in the projection and the wall defining the socket;

operating the directional boring machine a second time in a manner effective to widen an existing hole using the back reamer;

removing the pin from the alignable transverse openings provided in the projection and the wall defining the socket; and removing the projection from the socket so that the back reamer is removed from the starter rod.

31. The method of claim 29, wherein the removable pin comprises an elongated roll pin, and the means for resisting disengagement comprises configuring the roll pin to resiliently engage inner surfaces of the alignable transverse openings, wherein the pin inserting step further comprises hammering an end of the roll pin into the transverse openings, and the pin removing step further comprises hammering an end of the roll pin inside the transverse openings in a manner effective to move the roll pin out of the transverse openings.

* * * * *